US005297302A

United States Patent [19]

Anderson

[11] Patent Number: 5,297,302

[45] Date of Patent: Mar. 29, 1994

[54] HAMMOCK STAND

[76] Inventor: Bill R. Anderson, 24 Airport Rd., Freedom, Calif. 95019

[21] Appl. No.: 975,802

[22] Filed: Nov. 13, 1992

[51] Int. Cl.[5] ..... A45F 3/24

[52] U.S. Cl. ..... 5/127; 403/174; 403/217

[58] Field of Search ..... 5/127-130; 403/217, 174, 178

[56] References Cited

U.S. PATENT DOCUMENTS 2,104,917 1/1938 Tischler ..... 5/129
4,958,391 9/1990 Egeland ..... 5/127

*Primary Examiner*—Alexander Grosz
*Attorney, Agent, or Firm*—Jacques M. Dulin; Harold T. Fujii

[57] ABSTRACT

An improved hammock stand including a central base pipe, a pair of canted upstanding arm pipes, a set of four foot extension pipes, and a pair of connector assemblies to which the individually mountable/demountable feet extension, arm and base pipes may be telescopingly mounted. Each connector unit has a pair of extension pipes welded to a bowed crosspiece pipe oriented concave down. The extension pipes are identical in character and disposed on the crosspiece pipe such that the pipes lie in a vertical plane which passes transversely through the crosspiece at the center of the bend. The arm and base pipes telescopingly mount onto the extension pipes; the foot extension pipes telescopingly mount onto the crosspiece pipe so that they are canted downwardly and outwardly from about one to about five degrees. The bend in the crosspiece pipe creates a vertical lift beneath the connector assemblies and the central base pipe thereby compensating for uneven ground surface levels, and stabilizing and cushioning the support of the hammock. In addition, the outer diameter of the crosspiece and extension pipes when compared to the inner diameter of the feet, base and arm pipes, provide enough clearance such that the feet, base and arm pipes may be easily slipped on and off the crosspiece and extension pipes in order to prevent jamming and, thus avoiding a problem of not being able to disassemble the unit once it has been assembled.

7 Claims, 2 Drawing Sheets

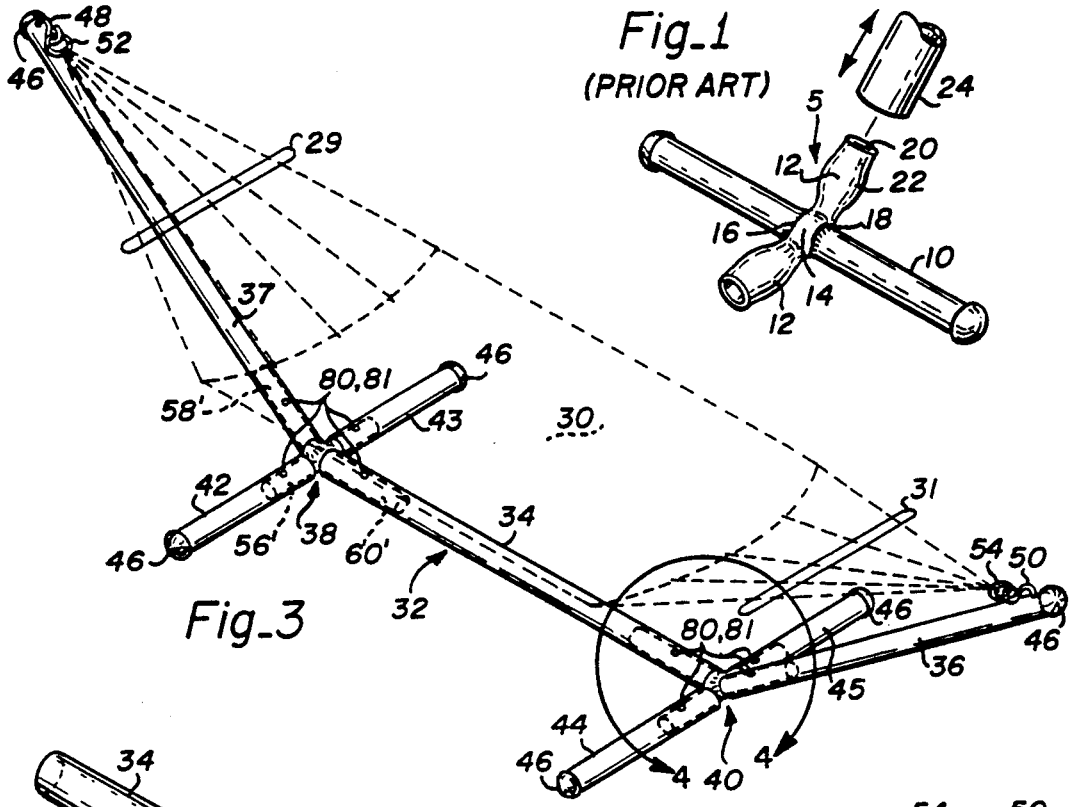
Fig_3
Fig_1 (PRIOR ART)
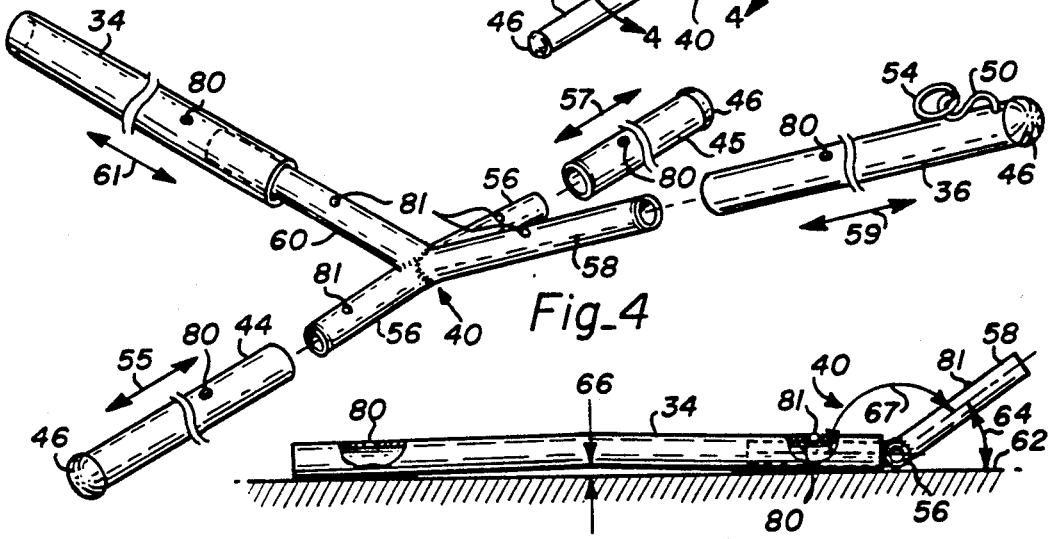
Fig_4
Fig_6
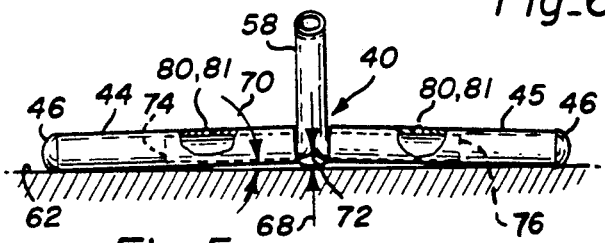
Fig_5
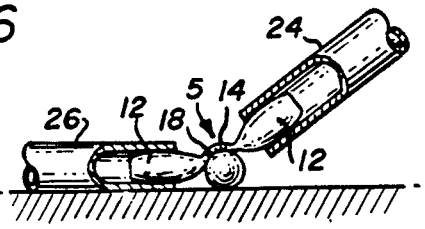
Fig_2 (PRIOR ART)

HAMMOCK STAND

FIELD

The invention relates to stands, more particularly to hammock support stands which are multi-part, easily assembled and disassembled, and which employ a universal connector for the parts.

BACKGROUND

Hammocks are suspended from two spaced-apart connector points. Where there are no natural and properly spaced objects, such as trees, to secure a hammock connecting ring, walls or posts may be used. However, where the hammock is desired to be moved from place to place, hammock supports or stands are employed. One popular type of stand is a "sled" type which employs two spaced-apart rails and raised ends which meet at a common point above ground. These ends contain rings or S-hooks for securing the ends of the hammock.

Another type of stand is the "single rib" type. Both types are typically made of light gauge steel coated with plastic for rust protection.

The single rib-type stand includes a central rib pipe, and two upstanding arms which are connected by a foot connector assembly. The foot connector assembly 5, illustrated in FIG. 1, comprises a single 4-foot crosspiece 10 to which is welded a single "C"-shaped bent tube 12 which is placed with a concave surface 14 upwardly. The tube 12 is welded, at a plurality of joints 16 and 18, to the crosspiece to form the foot. Also, both ends of the tube 12 are tapered with a smaller end 20 and a somewhat enlarged medial section 22 so that the center rib pipe (not shown) and the upstanding arm 24 may fit thereon.

Turning now to FIG. 2, which depicts a partially sectional view of the assembly 5. A serious disadvantage of the assembly 5 is that the arm 24 and a center rib pipe 26 wedge so tightly on the connector that they cannot be removed from the connector after they are installed. In addition, the plastic sheathing becomes easily scratched and the thin metal tubing rusts easily. The lift of the stand is very short, and its inability to disassemble makes it an undesirable design. In addition, on uneven ground the straight cross-piece is unstable. The thin wall construction is not rigid and the hammock experiences bouncing and cannot support properly very heavy or multiple users.

Accordingly, there is a clear need in the art for a hammock support structure which overcomes the problem of currently commercially available units.

THE INVENTION

Objects

It is among the object of this invention to provide a rib-type hammock stand which is easy to assemble and disassemble for off-season storage.

It is another object of the invention to provide a heavy duty hammock stand that has a lifetime user life.

It is another object of the invention to provide a rib-type hammock stand in which the foot extensions do not wedge together in their connected position such that they cannot be disassembled.

It is another object of the invention to provide a hammock stand that resists rusting thereby enhancing disassembly and preventing failure of the parts.

These and other objects will be evident from the specification, drawings and claims in this case.

DRAWINGS

FIG. 1 is an isometric view of a hammock stand foot connector typically found in the prior art;

FIG. 2 is a partially broken side elevational view of the prior art foot connector shown in FIG. 1;

FIG. 3 is an isometric view of a hammock stand in accordance with the present invention;

FIG. 4 is an enlarged isometric view of an area 4—4 illustrated in FIG. 3;

FIG. 5 is a forward elevation view of a portion of the hammock stand illustrated in FIG. 3;

FIG. 6 is a side elevation view of a portion of the hammock stand illustrated in FIG. 5;

SUMMARY

Figure 7:
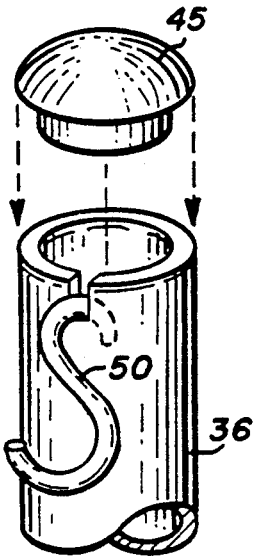
FIG. 7 is an enlarged view of a preferred device for attaching the hammock to the support stand illustrated in FIGS. 3 and 4.

The invention comprises a multi-part rib-type hammock stand fabricated of galvanized iron piping or equivalent which includes a special connector assembly to which individually mountable/demountable feet, arm and base pipes may be telescopingly mounted. The connector comprises a plurality of welded extension pipes, usually two, and a special bowed crosspiece pipe. The arm and base pipes are telescopingly mounted onto the extension pipes. The foot extension pipes are telescopingly mounted onto the crosspiece so that they are canted downwardly and outwardly from about one to about five degrees. This provides compensation for uneven ground surfaces, raises the center base pipe slightly for a spring effect (described below). The gauge and the outer diameter of the crosspiece and extension pipes, as compared to the inner diameter of the feet, base and arm pipes, are such that the feet, base and arm pipes may be easily slipped on and off the crosspiece and extension pipes without jamming or wedging together, and thus avoiding the serious problem of not being able to disassemble the unit once it has been assembled. The gauge and diameters are selected to permit all of the piping to be fully telescopingly mounted onto the crosspiece and extension pipes so that they come into contact with each other at the center of the crosspiece.

In the prior art rib-type hammock stands, upon use, the pipes have such snug fits that they become wedged together such that they cannot be disassembled. The lever arm force that is involved in causing the prior art pipes to wedge together is far greater than the strength of an individual to pull them apart, and there is no way to reverse the lever force because that is created during use with the person lying in the hammock. Further the repeated acts of the user in getting on and off the hammock causes the pipes of the prior art stand to work themselves further onto the connector into a permanently wedged condition.

The connector of this invention is universal in that the welded extension pipe which receives the arm and the extension pipe which receives the center base pipe are identical, and only a single curved crosspiece needs to be fabricated. That is, there is not a right and a left crosspiece, but rather a single crosspiece in which either of the straight parts can function to receive either the arm or the center base pipe, or vice versa.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

FIG. 3, illustrates a hammock 30 supported by a rib-type stand assembly of the present invention 32. The assembly 32 includes a plurality of connector assemblies 38 and 40, a central base pipe 34, a pair of cantilevered arm pipes 36 and 37, a plurality of foot extension pipes 42, 43, 44, 45, a plurality of end plugs 46, and a pair of "S"-shaped hooks 48 and 50. It should be noted that the connector assemblies 38, 40 may each have a plurality of spring-loaded ball detents 81 disposed in a wall of each of their component arm pipes. Additionally, the pipes 34, 36, 37, 42–45 have associated holes 80 formed therein such that, as discussed below, when the pipes are properly mounted onto the connector assemblies the detent balls are in registry with the holes, thereby releasably locking the pipes onto the connector assembly and preventing rotational and lateral slippage of the pipes.

FIG. 4 is an enlarged view of the connector assembly 40. The assemblies 38 and 40 are identical and interchangeable with each other. The assembly 40 includes a bowed or bent crosspiece 56, a welded extension tube 58, and a welded extension tube 60. A spring-loaded ball 81 is disposed medial of the outer ends of the tube 58 (or 60). In addition, a spring-loaded ball 81 is disposed medial of each end of the crosspiece 56, e.g., at a location generally equidistant between the outer end of the crosspiece and the center of the crosspiece.

As seen on FIGS. 4 and 5, foot pipes 44 and 45 are telescopingly mounted to the ends of the crosspiece 56, as indicated by the arrows 55 and 57. Also, the arm pipe 36 and base pipe 34 are telescopingly mounted to the tubes 58 and 60, respectively, as indicated by the arrows 59 and 61. In similar fashion, the pipes 42 and 43 are telescopingly mounted to the crosspiece 56' of the assembly 38 (FIG. 3), and the pipes 37 and 34 are also telescopingly mounted to the tubes 58' and 60' of the assembly 38 (FIG. 3). The pipes are slid onto its associated crosspiece tube until the pipes meet at the center, and optionally the corresponding holes 80 and detents 81 are aligned. The locking action between the detents and the hole prevents the pipes from rotational movement which may cause the support stand to move, or if the arm pipes rotated, the hammock to twist.

It should be noted that the connector assembly is universal in that the welded extension tube which receives the arm pipe and the extension tube which receives the base pipe are identical, and only a single crosspiece needs to be fabricated. That is, there is not a right and a left crosspiece but rather a single crosspiece in which either of the straight parts (i.e., extension tube) can function to receive either the arm pipe or the base pipe or vice versa.

The hooks 50 and 48 are disposed at the closed ends of the pipes 36 and 37. A plurality of hammock support lines 29 and 31 extend out from the hammock ends and are gathered by their respective eyelet rings 52 and 54. The hammock 10 is supported by the stand assembly 32, via the eyelet rings 52 and 54 hooked by the respective "S"-shaped hooks 48 and 50 of the arms 36, 37.

By way of example, the outside diameter of the connector crosspiece and extension tubes is generally 1.625 inches. The outside diameter of the central base or rib pipe, the foot extension pipes, and the upstanding arm pipes is generally 1.875 inches with a pipe wall thickness of 0.065 inches for structural grade galvanized steel pipe to 0.090 inches for "TUF-20" galvanized steel pipe (available from American Tube Corp, Phoenix, Ariz.). It is preferred to use full weight galvanized pipe for the connector assembly, and "TUF-20" for the slipped-on base, foot and arm pipes. Thus, the space or gap between the connector assembly pipe and a corresponding telescopingly mounted pipe is generally about 0.120 to 0.070 inches. Thus, the base, foot, and arm pipes may be easily slipped on and off the connector assembly in order to prevent jamming, thereby avoiding the prior art problem of not being able to disassemble the unit once it has been assembled. Further, the use of galvanized pipe resists rust, as compared to the prior art use of cheap, mild "tube" steel.

As noted above, in the prior art rib-type hammock stands, upon use, the pipes have jam fits which become wedged such that they cannot be removed from the connector tubes. The force that is involved in causing the prior art pipes to wedge to the connector tubes is far greater than the strength of an individual to pull them apart. Thus, the prior art stand, once assembled, cannot be easily disassembled.

It should be further noted that the pipes and connector are fabricated from galvanized steel to hinder rust formation. Also, the likelihood of scratches and scraping the pipes and connector, thereby removing the protective coating, is mitigated because of the liberal gap formed between the telescopingly mounted parts.

FIG. 5 further illustrates the connector assembly 40. It will be appreciated from the figure that the crosspiece 56 is bowed or bent such that its ends are canted downwardly at an angle 70 less than 10° down from the horizontal, preferably in the range of from about 1 to about 5 degrees. A notch or bend 72 is formed in the tube wall of the crosspiece by suitably clamping the ends 74, 76 and applying sufficient force to a point equally spaced from the ends. The force is continuously applied until the angle 70 is achieved. The tubes 58, 60 are then welded to the un-notched upper surface of the crosspiece. The tubes are aligned with each other so that they each lie in the same vertical plane that transversely passes through the crosspiece at the location of the notch or bend 72.

When the associated foot extension pipes 44 and 45 are telescopingly mounted onto the ends of the crosspiece, the center of the crosspiece is raised above the ground 62 by a distance 68. The value of the distance 68 is typically less than 3 inches, preferably in the range of from about ¼ to 2¼ inches.

FIG. 6 illustrates a side elevational view of the connector assembly 40. The figure shows that the tube 58 (or tube 60) is angled off from the horizontal by an angle 64. Typically, the value of angle 64 ranges from 20 to 60 degrees, with a preferred value of about 30 degrees. That is, an included angle 67 between the tubes ranges from 120 to 160 degrees with a preferred value of about 150 degrees.

It should also be noted from the figure that because of the bend formed in the crosspiece there is a slight lift 66 present in the pipe 34 when it is mounted on the assemblies 38 and 40. Typical values for lift 66 range from about ¼ to 1θ inches.

When the hammock is unoccupied, the lift or bow 66 is present beneath the connector assemblies and the central rib pipe. When the hammock is occupied, however, the lift in the central rib tends to be completely flattened out and the lift beneath the connector is reduced. This "flattening", or downward movement of the connector and the central base pipe, when the hammock is occupied, creates a "spring-like" action that provides compensation for uneven ground surfaces, stabilizes the stand on such uneven ground surface, and cushions the occupant supported by the hammock.

Bowing the crosspiece, thereby lifting the central rib pipe slightly, permits the base and foot extension pipes associated with the connector assembly to be telescopingly mounted onto the crosspiece and base pipe extension tubes while the connector is on the ground. You don't have to scrape earth to slip the tubes on the connector so that they come into contact with each other at the center of the connector assembly. This, in addition to the differential in diameters discussed earlier, results in easy installation and removal of the pipes from the connector's crosspiece and tubes.

In contrast, if the crosspiece was not bowed but rather a straight piece (as in the prior art) then when the hammock is occupied the weight of the occupant acting in concert with the length of the upstanding arms creates a significant torsional force that wedges the crosspiece and extension tubes into the pipes mounted thereon. The crosspiece and extension tubes are jammed into the pipes, and disassembly of the connector from the pipes is very difficult.

FIG. 7 illustrates an enlarged view of the closed end of the arm pipe 36 and depicts several preferred embodiments for attaching the hook 50 to the pipe 36. The hammock 30 is mechanically coupled to the hook 50, via an eyelet 54 (FIG. 3). A first (preferably narrower) end 51 of the hook is hooked through a cutout 37 formed in an end surface 39 of the pipe 36. The hook 50 is locked to the pipe 36 when the plug 46 is swagged into the pipe open end. Although the plug may be friction fitted into the open end, its flanged surface 49 may also be glued or otherwise adhesively joined to the surface 39. It should be noted that while only one upstanding pipe and associated hook device are illustrated and described, the opposite arm and hook are identical in description and assembly.

Figure 8:
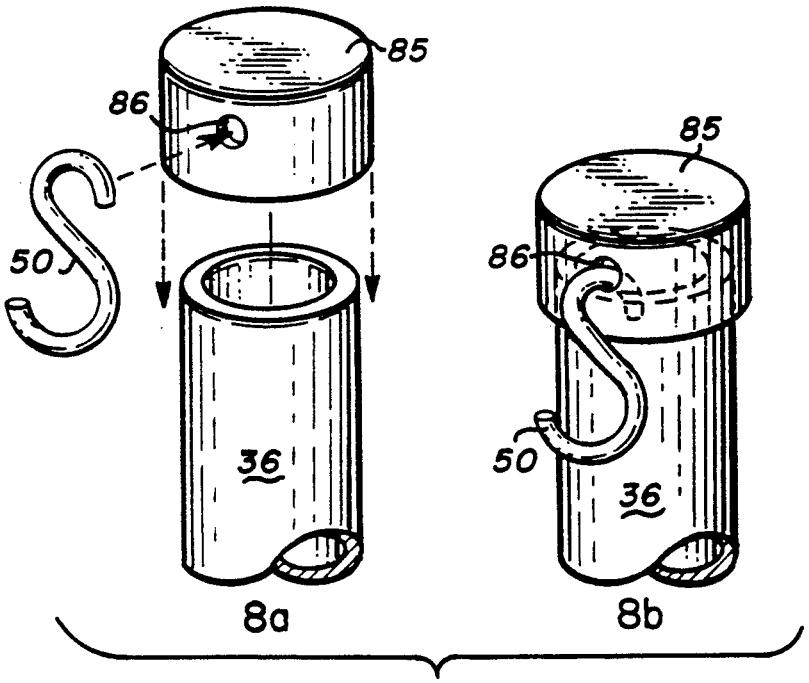
FIGS. 8A and 8B are enlarged views of alternative devices for attaching the hammock to the support stand illustrated in FIGS. 3 and 4.

FIG. 8A and 8B depict an alternative system for attaching the hook 50 (or 52, FIG. 3) to the pipe 36 (or 37, FIG. 3). The hook 50 is attached to the pipe 36 using an end cap 85 with an aperture 86 formed therethrough. In this embodiment, the narrower end 51 of the hook is inserted through the aperture which is sized to provide a tight press fit entry. The cap with the attached hook, is slipped onto the pipe's open end until the hook's first end is clamped within the aperture by the surface 39 of the pipe. The cap may be friction fitted, welded, or adhesively joined onto the pipe's open end. A plastic end cap of a PVC schedule 40 waterpipe slip-fit type end cap is preferred.

Figure 9:
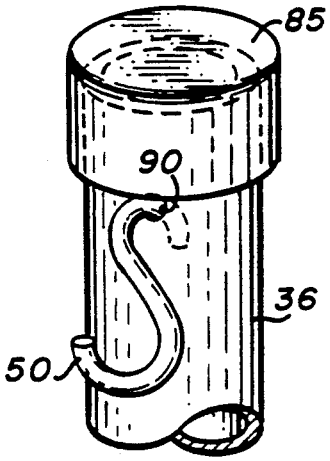
FIG. 9 is an enlarged view of another alternative device for attaching the hammock to the support stand illustrated in FIGS. 3 and 4.

FIG. 9 shows another alternative device for attaching the hook 50 (or 52, FIG. 3) to the pipe 36 (or 37, FIG. 3). The hook's first end 51 is passed through a snug fit aperture 90 formed in the pipe 36. The cap 85 is slip fitted, threaded on, or adhesively joined to the pipe open end. The cap is slid onto the pipe until the narrower end of the S-hook is clamped within the aperture 90 by a lower shoulder 91 of the cap 85.

Figure 10:
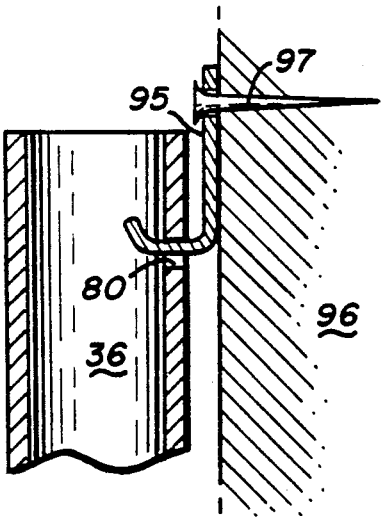
FIG. 10 is sectional view of a device for hanging several components of the hammock support stand.

FIG. 10 depicts a device for hanging the pipes of the hammock support stand such that the stand may be stored during periods of non-use. All the pipes, e.g. pipe 36, can be hung on a surface 99 of a structure 96 wall or other support, via a hook 95 and a fastener 97. The hook 95 is mounted onto the surface using the fastener; the hook is passed through the detent hole 80 thereby suspending the pipe 36 from the hook 95. It should be noted that while only pipe 36 is illustrated, the foregoing description and discussion is applicable to all of the pipes, since they each have detent holes 80 (FIG. 4) formed therein.

Where it is desired to have a rollable hammock stand, the detents 81 can be omitted from the bowed crosspieces 42 and 44. The foot extension pipes are slipped on the crosspiece feet 56. Since the crosspiece is bowed, only the portions of the pipes 42–45 adjacent their outer ends touch the ground. The center base pipe 34 is raised slightly and does not drag. The entire assembly can roll with the pipes 42–45 journalled on their respective crosspiece feet, albeit not too easily. That is, it can be moved from place to place by rolling but the foot extensions 42–45 will remain on the crosspieces to stabilize the hammock in a desired resting place.

By way of example, the arm pipes 36, 37 may have a length of 6' each, the base pipe 34 may be 5'–6', and each of the feet extensions 42–45 may be 2'–2½' in length. The extension tubes and the bowed crosspiece are on the order of 1' in length each.

It should be understood that various modifications within the scope of this invention can be made by one of ordinary skill in the art without departing from the spirit thereof. For example, a threaded end cap may be employed in place of a slip-fit cap. For colored pipes, the pipes may be painted or plastic overcoated, e.g., a colored PVC overcoating. I therefore wish my invention to be defined by the scope of the appended claims as broadly as the prior art will permit, and in view of the specification if need be.

I claim:

1. A portable, mountable and disassemble stand assembly for supporting a hammock comprising in operative combination;

a) a first connector (40) having a first crosspiece pipe (56), a first extension tube (60), and a second extension tube (58), said first and second tubes extending away from said first crosspiece pipe and secured permanently thereon, and said crosspiece pipe having a first and a second end;

b) a second connector (38) having a second crosspiece pipe (56'), a third extension tube (60'), a fourth extension tube (58') said third and said fourth tubes extending away from said second crosspiece pipe and secured permanently thereon, and said crosspiece pipe having a third and a fourth end;

c) a central base pipe (34) having a first open base pipe end and a second open base pipe ned, said first base pipe open end telescopingly mountable onto said first extension tube (60) and said second base pipe open end telescopingly mountable onto said third extension tube (60');

d) said crosspieces being bowed concave down to create a vertical lift (68) beneath said first and second connectors and said central base pipe (66) beneath said first and second connectors and said central base pipe (66) to compensate for uneven ground surface levels, and to provide stabilizing and cushioning support of said hammock;

e) a first upstanding arm pipe (36) having a first open arm pipe end and a second arm pipe end, said first arm pipe open end telescopingly mountable onto said second extension tube (58), and said second arm pipe end having means (50) for mechanical coupling to a first end of a hammock 30;

f) a second upstanding arm pipe (37) having a third open arm pipe end and a fourth arm pipe end, said third arm pipe open end telescopingly mountable onto said fourth extension tube (58'), and said fourth arm pipe end having means (48) for mechanical coupling to a second end of said hammock; and g) the inner diameter of said base pipe and arm pipes being oversized with respect to the outer diameter of said connector pipes and tubes to permit ease of mounting and disassembly without wedging together.

2. A hammock stand as in claim 1, which includes:

a) a plurality of foot extension pipes (42, 43, 44, 45) telescopingly mountable onto and demountable from said first, second, third, and fourth crosspiece pipe ends, respectively.

3. A hammock stand as in claim 1, wherein:

a) each of said crosspiece pipes (56, 56') has a first crosspiece end and a second crosspiece end with at least one notch formed in said first crosspiece pipe, said notch (72) located between and generally equidistant from said first crosspiece end and said second crosspiece end and formed in said concave side;

b) said each of said extension tubes (58, 58', 60, 60') are welded to an un-notched surface of said crosspiece pipe; and c) said extension tubes being identical and disposed on said crosspiece pipes such that said extension tubes lie in a common vertical plane, which transversely passes through said crosspiece pipe at the location of said notch.

4. A hammock stand as in claim 3, which includes:

a) a plurality of foot extension pipes (42, 43, 44, 45) telescopingly mountable onto and demountable from said first, second, third, and fourth crosspiece ends, respectively.

5. A hammock stand as in claim 4 which includes:

a) at least one releasable locking means (80, 81) mounted on said connector on at least one of said extension tubes for engaging at least one of said arm pipes, or said base pipe.

6. A hammock stand as in claim 5 which includes:

a) at least one releasable locking means (80, 81) mounted on at least one of said crosspiece pipes for engaging at least one of said foot extension pipes.

7. A hammock stand as in claim 6 wherein:

a) a said locking means is a spring detent.

* * * * *